US005577829A

United States Patent [19]

Hall

[11] Patent Number: 5,577,829

[45] Date of Patent: Nov. 26, 1996

[54] FLASHLIGHT WITH TOOL BIT ATTACHMENT

[76] Inventor: Timothy E. Hall, 18178 Bonnie La., Fontana, Calif. 92335

[21] Appl. No.: 370,298

[22] Filed: Jan. 9, 1995

[51] Int. Cl.[6] ..... B25B 23/18

[52] U.S. Cl. ..... 362/119; 362/120

[58] Field of Search ..... 362/119, 120, 362/208

[56] References Cited

U.S. PATENT DOCUMENTS

| | | |
|---|---|---|
| 2,242,536 | 5/1941 | Montgomery . |
| 2,288,093 | 6/1942 | Kaffenberger et al. . |
| 2,341,375 | 2/1944 | Hambleton . |
| 2,466,342 | 4/1949 | Watts . |
| 2,706,769 | 4/1955 | Cook . |
| 2,783,364 | 2/1957 | Wood, Jr. . |
| 3,185,832 | 5/1965 | Nagamori . |

*Primary Examiner*—James C. Yeung
*Assistant Examiner*—Alfred Basichas
*Attorney, Agent, or Firm*—Knobbe Martens Olson & Bear

[57] ABSTRACT

A flashlight with a tool mounting stud that is configured to receive a plurality of different types of commonly available tool bits. The tool mounting stud is positioned at substantially the center of a focusing lens of the flashlight and is retained in this position by a plurality of spokes which are connected to a lip formed around the outer surface of the focusing lens. The lens assembly of the flashlight is secured in position by a securing device which prevents rotation of the lens assembly relative the body of the flashlight during manipulation of a fastener by a user using the flashlight tool. In one embodiment, the securing device is comprised of at least one set screw which engages with both the lens assembly and the body to prevent rotation of the lens assembly. In another embodiment, the securing device is comprised of a groove formed on a section of the body and a tab formed on a section of the lens assembly which interact to inhibit rotation of the lens assembly.

38 Claims, 4 Drawing Sheets

FLASHLIGHT WITH TOOL BIT ATTACHMENT

BACKGROUND OF THE INVENTION

1. Field of the Invention

The present invention relates to a tool which can be used to manipulate nuts, bolts, screws and other fasteners in poorly lighted environments and, in particular, concerns a flashlight apparatus which has a mounting stud for tool bits.

2. Background of the Invention

Many components of automobiles and industrial equipment that require periodic servicing are positioned in poorly lighted environments. For example, industrial control components, such as electronic controls for air conditioner systems, are often positioned inside of unlighted enclosures. These components are often positioned next to exposed high voltage sources or next to delicate components, such as circuit boards, that can be easily damaged.

In these environments, it is necessary for a technician performing the servicing to use a light source to illuminate the area adjacent the component that is to be serviced. Further, the technician often has to remove or otherwise manipulate the component from inside the enclosure to adequately service or replace the component. Hence, the technician generally uses a screwdriver, wrench or socket wrench to either loosen the nuts, bolts or screws that are securing the component inside of the enclosure or to adjust a screw, nut or bolt which controls the operation of the component.

One common type of light source used by technicians in this situation is a trouble light which is a light that is connected to an outlet by an extension cord and can be hung in a position where the component is illuminated. One problem with a trouble light is that it requires that there be an electrical outlet positioned in the vicinity of the equipment that is to be serviced. Often, there is no readily accessible outlet. Further, a trouble light with an extension cord is a bulky item which many technicians do not carry when performing inspections and adjustments of equipment.

However, many technicians carry small "pencil" style flashlights to illuminate the component during servicing, replacement or repair. It can be appreciated, however, that servicing of the components often requires that the technician use both hands to manipulate the tool leaving no hand for the technician to hold the flashlight. Hence, there is a need in the prior art for a compact portable light source that can be used to illuminate a component but does not require the technician to hold the light source in addition to holding a tool.

To address this particular problem, several illuminated tools have been developed. For example, U.S. Pat. No. 2,242,536 discloses a screwdriver device which contains a light source that provides light in the direction of the shaft of the screwdriver. The screwdriver bit in U.S. Pat. No. 2,242,536 is inserted into a socket in a handle portion of the screwdriver and the light source is positioned inside of the handle behind the socket. While this device does provide light in a position adjacent the component to be serviced, this has several disadvantages.

In particular, the device disclosed in U.S. Pat. No. 2,242,536 is limited to receiving screwdriver bits that are specifically configured to be positioned inside of the socket. Hence, the user of the device shown in this patent is limited to using screwdriver bits that are specifically made for this device.

This limits the use of the device as many commonly available attachments and bits designed to be used with socket-type wrenches cannot be used with the device. Further, the device disclosed in U.S. Pat. No. 2,242,536 is not a very effective light source and cannot be efficiently used as a flashlight. Thus, the device disclosed in U.S. Pat. No. 2,242,536 is limited in its versatility as it can only be used with specifically designed screwdriver bits and the arrangement of the socket and light in the handle makes the device a relatively poor light source.

Several other devices similar to the device shown in U.S. Pat. No. 2,242,536 have also been developed. Specifically, U.S. Pat. Nos. 2,706,769, 2,288,093 and 3,185,832 disclose lighted screwdriver devices. However, the devices disclosed in each of these patents suffer from the same or similar shortcomings as the device disclosed in U.S. Pat. No. 2,242,536.

Hence, there is a need in the prior art for a tool that has a light source which is designed to be used with many different commonly available tool bit attachments. Further, there is also a need for a lighted tool device having a light source which produces a light beam that is focused and of a sufficient intensity so that the device can also function as a flashlight. To this end, the focused beam of light should preferably illuminate the area adjacent the tool member of the lighted tool device without blocking the focused beam of light.

SUMMARY OF THE INVENTION

The aforementioned needs are satisfied by the illuminated flashlight tool of the present invention which is comprised of a flashlight body, which includes a light source, a focusing lens assembly, and a tool mounting stud. The lens assembly is mounted on the flashlight body so that a focused beam of light is produced. The tool mounting stud is mounted on the lens assembly so that the tool mounting stud is positioned within the focused beam of light. The tool mounting stud preferably allows for different tools to be positioned thereon.

In the preferred embodiment, the tool mounting stud is configured to allow for prior art socket wrench accessories to be mounted thereon. Furthermore, the tool mounting stud is preferably positioned so that the beam of focused light emanating from the focusing lens illuminates the area directly adjacent the tool mounting stud to thereby illuminate the screw, nut or bolt that is to be manipulated by the flashlight tool.

In the preferred embodiment, the tool mounting stud is mounted so as to be substantially centered in front of the exterior face of the focusing lens. The tool mounting stud is preferably maintained in this positioned by a plurality of radially extending spokes which attach to the outer casing of the body of the flashlight. The spokes are configured to block as little light as possible while still retaining the stud in the desired position. It can be appreciated that positioning the mounting stud in this fashion reduces the amount of light blocked by the mounting assembly and maximizes the amount of focused light produced by the flashlight tool.

In one embodiment, the flashlight has a lens assembly which is screwed onto the top of the flashlight body and the tool mounting stud is mounted on the lens assembly substantially centered in front of the focusing lens in the previously described manner. The lens assembly preferably includes several openings for set screws and the set screws interact with the flashlight body to prevent rotation of the lens assembly about the flashlight body as a result of manipulating a fastener, e.g., tightening or loosening a screw, nut or bolt, with the flashlight tool.

In another embodiment, the lens assembly is threaded on the end adjacent the flashlight body and the flashlight body includes a retaining ring which screws onto the threads on the lens assembly to retain the lens assembly on the flashlight. The lens assembly also includes two tabs that extend radially outward from the outer surface of the lens assembly and mate with two grooves in the flashlight body to prevent rotation of the lens assembly as a result of manipulation of a fastening device.

These and other objects and features of the present invention will become more fully apparent from the following description and appended claims taken in conjunction with the accompanying drawings.

DESCRIPTION OF THE PREFERRED EMBODIMENTS

Figure 1:
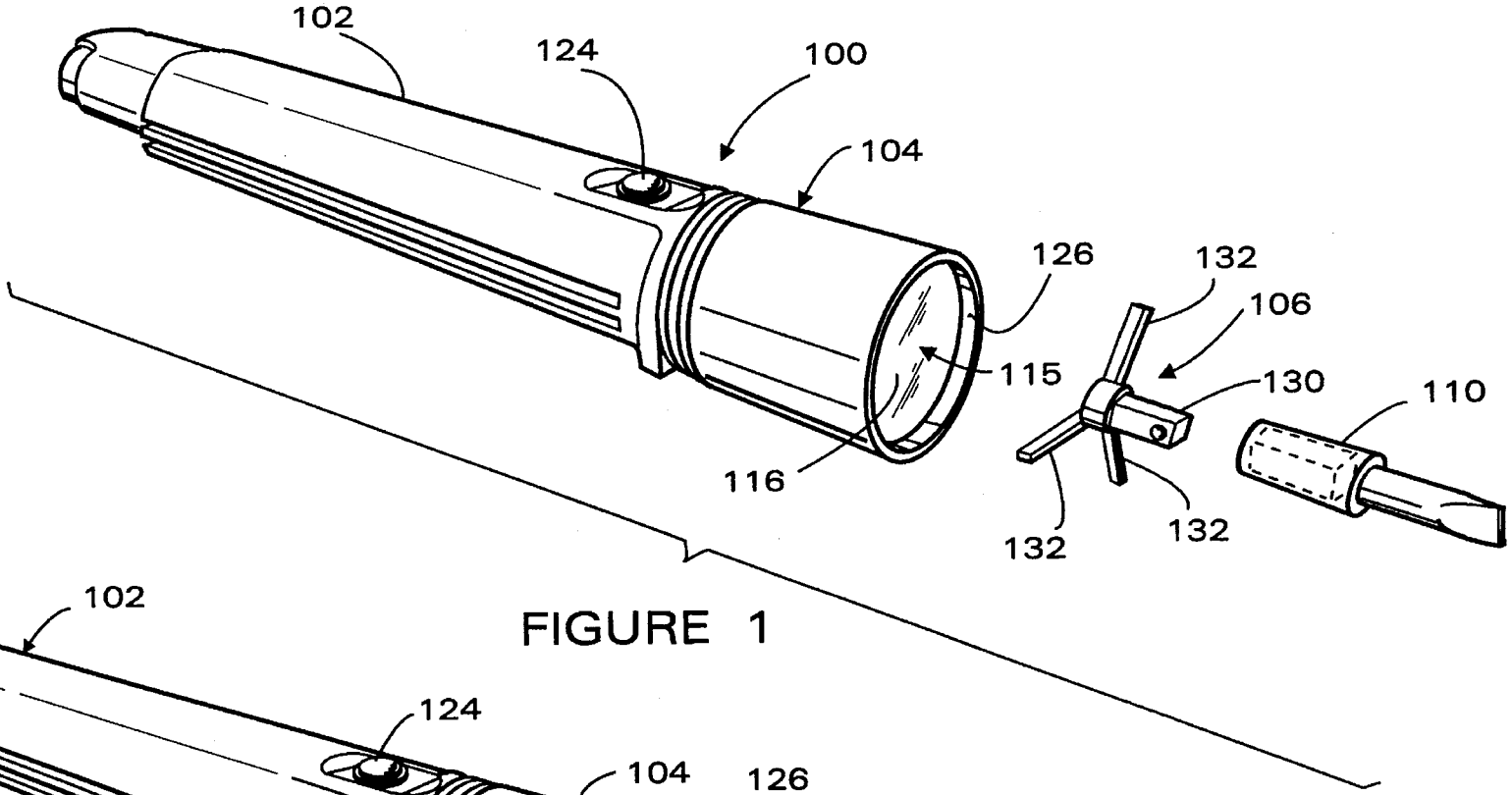
FIG. 1 is an exploded perspective view of one embodiment of the flashlight tool of the present invention.
Figure 2:
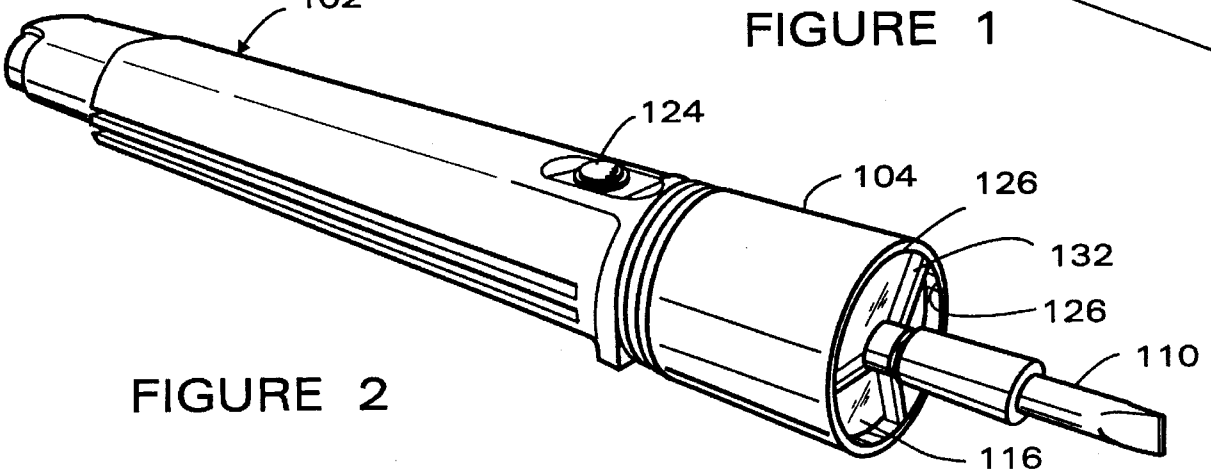
FIG. 2 is a perspective view of the flashlight tool shown in FIG. 1.
Figure 3:
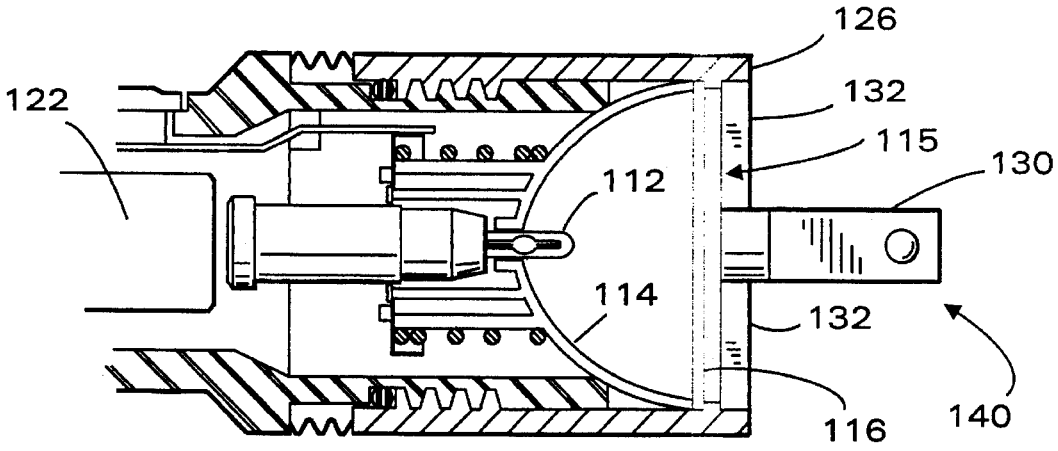
FIG. 3 is a side sectional view of the flashlight tool shown in FIG. 1.

Reference will now be made to the drawings wherein like numerals refer to like parts. FIGS. 1–3 illustrate one preferred embodiment of the flashlight tool apparatus 100 of the present invention. The flashlight tool apparatus 100 includes a flashlight body 102, a lens assembly 104, which is mounted on the flashlight body 102, and a mounting stud assembly 106, connected to the lens assembly 104, that is configured to receive a tool 110.

As illustrated in FIG. 3, the flashlight tool 100 includes a light source 112, which, in this preferred embodiment, is comprised of a well known flashlight light bulb. The lens assembly 104 includes a reflective shield 114 which is positioned around the light source 112 and a transparent member or focusing lens 116 that is positioned in an aperture 115 for the light produced by the light source 112. The reflective shield 114 reflects substantially all of the light produced by the light source 112 in a first direction towards the focusing lens 116. The focusing lens 116 then focuses the light produced by the light source 112 and thereby produces a focused beam of light which is directed outward from the lens assembly 104 through the aperture 115 in a direction substantially perpendicular to the plane of the focusing lens 116.

The light source 112 preferably receives electrical power from one or more batteries 122 (one shown in FIG. 3) that are positioned in the body 102 of the flashlight tool 100 and are electrically connected to the light source 112 in a manner that is well known in the art. Further, the light source 112 is actuated by a switch 124 mounted on the body 102 of the flashlight tool 100.

As shown in FIGS. 1–3, the aperture 115 of the lens assembly 104 has a lip 126 which extends outward from the outer surface of the focusing lens 116. As shown in FIG. 2, the mounting stud assembly 106 is fixedly attached to the lip 126, preferably by means of spot welding or soldering. The mounting stud assembly 106 includes a mounting stud 130 that is preferably a male stud that is configured to receive tools 110 that are designed to be used with well-known socket sets and nut driving sets. In this embodiment, three radially extending spokes 132 are connected to one end of the mounting stud 130. The radially extending spokes 132 are preferably spot welded or otherwise connected to the interior surface of the lip 126 so that the mounting stud 130 is positioned in front of the front face of the focusing lens 116 so that it extends outward from the focusing lens 116 in a direction substantially perpendicular to the plane of the focusing lens 116, i.e, in the direction of the axis 120 of the flashlight tool 100. The spokes 132 of the mounting stud assembly 106 are preferably equal in length so that the mounting stud 130 is substantially centered in the middle of the circular focusing lens 116 to thereby place the mounting stud 130 and the tool 110 in the focused beam of light emanating from the focusing lens 116 when the light source 112 is activated.

When the tool 110 is mounted on the mounting stud 130, and the light source 112 is activated, the reflective shield 114 and the focusing lens 116 direct the light in a direction which is substantially parallel to the axis 120, the mounting stud 130 and the tool 110. Hence, the user of the flashlight tool 100 can use the flashlight tool 100 to illuminate the fastener, e.g., screw, nut or bolt, that the user is seeking to manipulate, e.g., tighten or loosen.

Preferably, the spokes 132 are configured to adequately support the mounting stud 130 and the tool 110 while the user is using the flashlight tool 100 to manipulate a fastener while blocking only a minimum of the focused light emanating from the lens assembly 104. As shown in FIG. 1, the spokes 132 are generally rectangular in configuration and are preferably configured so that the width of the spoke 132, i.e., the cross sectional dimension perpendicular to the axis 120, is minimized so that as little of the focused beam of light emanating from the lens 116 is blocked. Hence, it can be appreciated that the spokes 132 allow almost all of the focused light produced by the lens assembly 104 to pass between the spokes 132. Thus, the flashlight tool 100 of the present invention does not occlude a significant amount of the focused light which results in better illumination by the flashlight tool 100.

Further, the focusing lens 116 is preferably adjustable so that the focused beam of light can be focused at different distances from the flashlight tool 100. In this embodiment, the lens assembly 104 is threadably mounted on the flashlight body 102. The focal point of the lens assembly 104 can thus be changed by rotating the lens assembly 104 on it threads about the flashlight body 102. This allow the user to use the flashlight tool 100 to not only illuminate objects which are immediately adjacent the flashlight tool 100, but also objects which are located farther away. Hence, the flashlight tool 100 is not limited to being used simply to illuminate fasteners to be manipulated by the flashlight tool 100, but can also be used as a flashlight to illuminate objects at a distance.

As shown in FIG. 1, the tool mounting stud 130 is configured to receive a tool 110 which is illustrated as a screw driver bit. It can be appreciated that other tools can be mounted on the tool mounting stud 130 without departing from the scope of this invention. For example, a nut driving socket, an extension rod and other tools can also be mounted on the tool mounting stud 130 in the same manner as is shown in FIG. 1.

Figure 4:
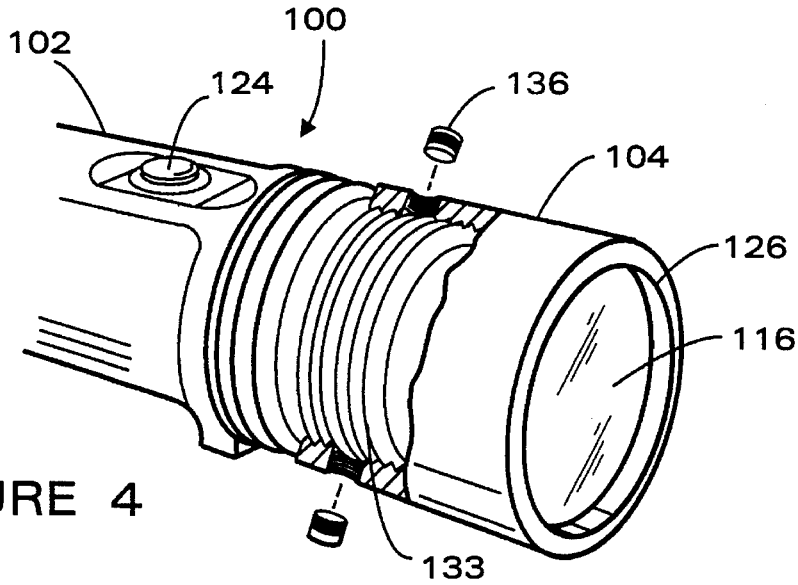
FIG. 4 is a partial perspective view of the flashlight shown in FIG. 3 illustrating a pair of retaining set screws which prevent rotation of the lens assembly of the flashlight tool with respect to the flashlight body resulting from manipulating a fastener with the flashlight tool.

Referring now to FIG. 4, as described previously, the lens assembly 104 in this embodiment is mounted on the end of the flashlight body 102 by means of a threaded interconnection. Specifically, threads 133 are formed on the outer surface of the flashlight body 102 and on the inside surface of the lens and light assembly 104. By rotating the lens and light assembly 104 on the threads 133 about the flashlight body 102, the user can adjust the focal point of the light produced by the flashlight tool 100. It can be appreciated, however, that manipulation of a fastener with the flashlight tool 100 can result in rotation of the lens assembly 104 about the flashlight body 102. To address this problem, this embodiment of the flashlight tool 100 includes a securing device comprised of two set screws 136 which extend through the lens assembly 104 and engage with the threads 133 on the flashlight body 102 to prevent rotation of the lens assembly 104.

Figure 5:
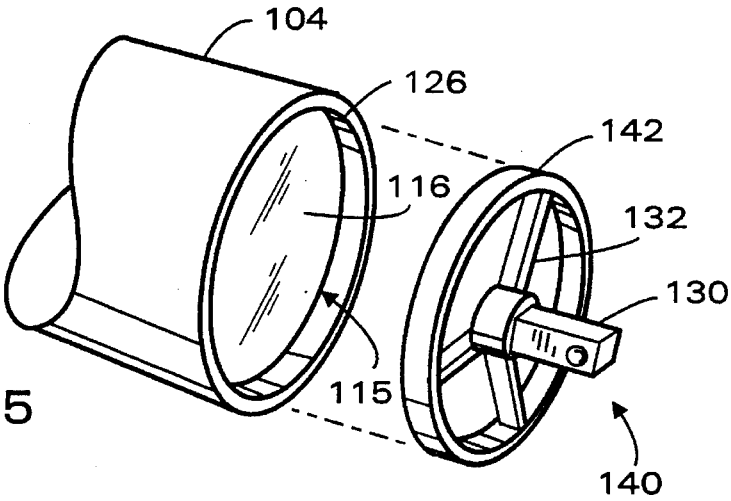
FIG. 5 is a partial perspective view of the flashlight tool of the present invention illustrating another embodiment of a tool mounting stud.

FIG. 5 illustrates another embodiment of a mounting stud assembly 140 that can be used in the flashlight tool 100 shown in FIG. 1. It can be appreciated that tightening or loosening a screw or bolt can result in tremendous force being exerted on the connections between the lip 126 and the radially extending spokes 132 shown in FIG. 2. To address this problem, the mounting stud assembly 140 shown in FIG. 5 includes a continuous ring 142 interconnecting each of the spokes 132. The continuous ring 142 is preferably integrally connected to each of the spokes 132 and the outer diameter of the continuous ring 142 is preferably nearly identical to the inner diameter of the lip 126. This allows the mounting stud assembly 140 to be positioned so that the continuous ring 142 is continuously welded or soldered to the inner surface of the lip 126 to thereby form a stronger connection between the mounting stud assembly 140 and the lens assembly 104.

Figure 6:
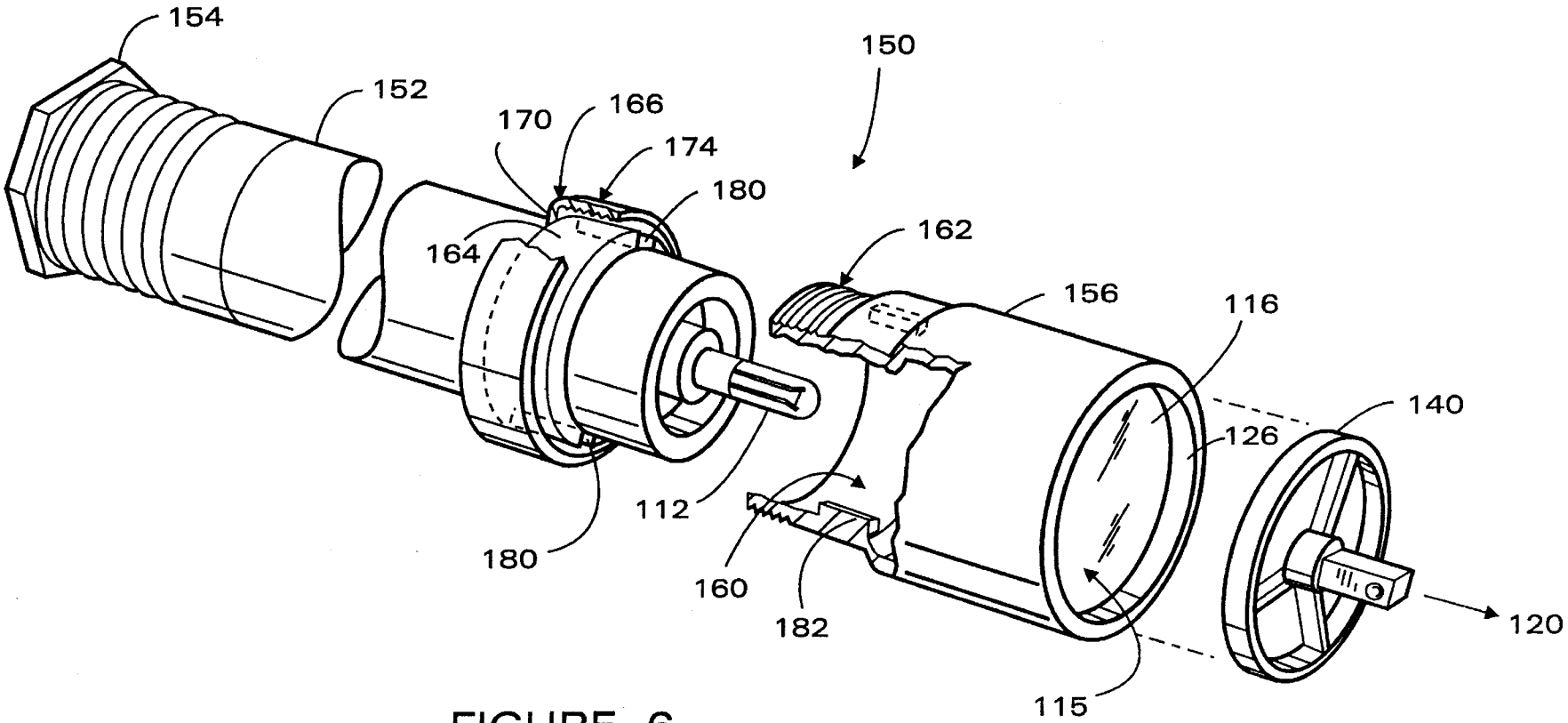
FIG. 6 is a exploded perspective view of another embodiment of the flashlight tool of the present invention.
Figure 7:
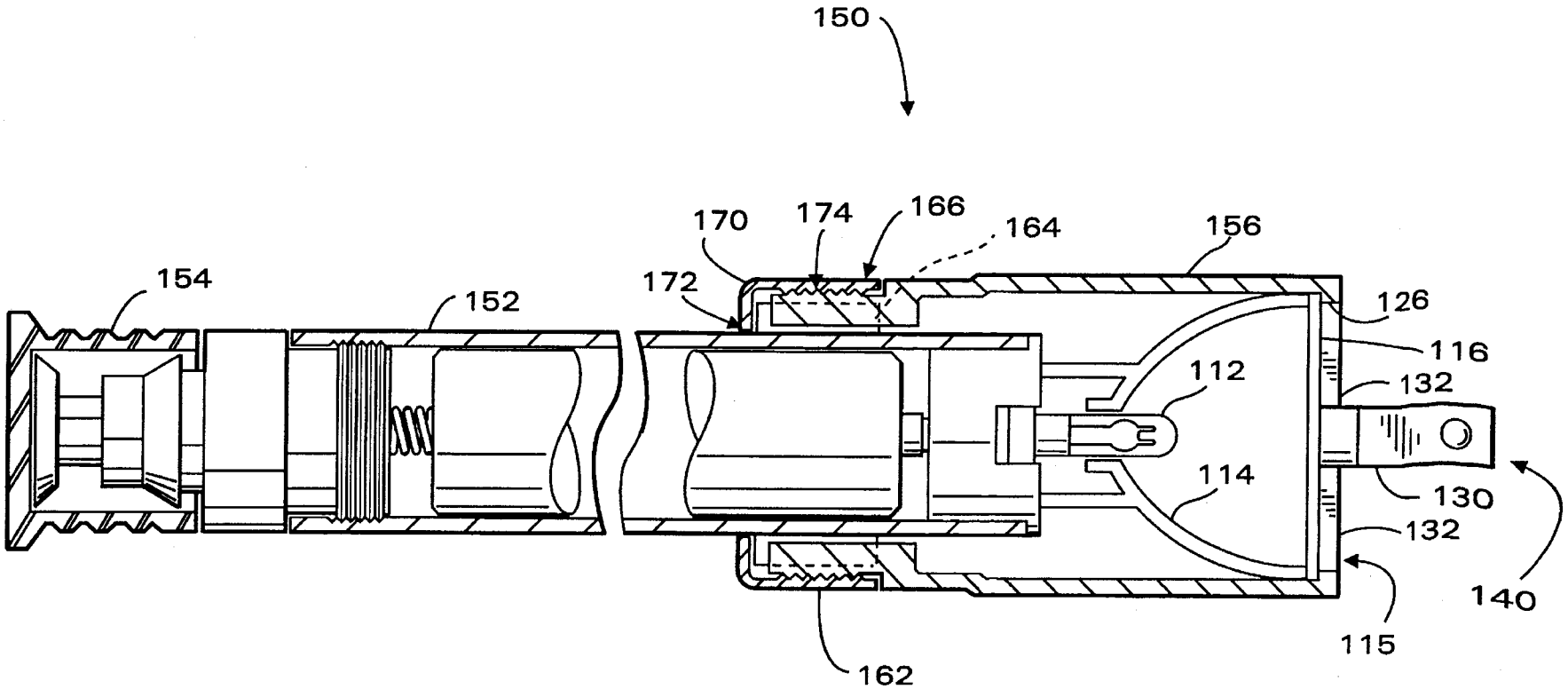
FIG. 7 is a partial side sectional view of the embodiment of the flashlight tool shown in FIG. 6.

FIGS. 6 and 7 illustrate another embodiment of the flashlight tool 150 of the present invention. The flashlight tool 150 includes a flashlight body 152 that has a switch 154, for activating the light source 112, which is mounted on the end of the flashlight body 152 opposite the end on which a lens assembly 156 is positioned. A mounting stud assembly 106 or 140 of either of the embodiments shown previously, is mounted on the lip 126 of the lens assembly 156.

The lens assembly 156 in this embodiment includes a focusing lens 116 positioned in an aperture 115 and a reflective shield 114 (see, FIG. 7) that are mounted in substantially the same fashion, and perform substantially the same function, as described above in reference to FIGS. 1–3. The assembly 156, however, attaches to the flashlight body 152 in a different fashion.

Specifically, the flashlight body 152, in this embodiment, is not threaded. However, the lens assembly 156 has an opening 160 which is configured to receive the flashlight body 152. This allows the lens assembly 156 to slide over the end of the flashlight body 152 adjacent the light source 112. The outer surface of the lens assembly 156 adjacent the opening 160 includes a threaded section 162. A collar 164 is preferably fixedly attached to the flashlight body 152 at a point adjacent the end of the flashlight body 152 adjacent the lens assembly 156.

A threaded retaining ring 166 is preferably positioned around the flashlight body 152 so that it is captured by the collar 164. Specifically, as shown in FIG. 7, the retaining ring 166 in this preferred embodiment has an inwardly extending flange 170 which forms an opening 172 that has a diameter less than the outer diameter of the collar 164. The retaining ring 166 also includes a threaded section 174 that extends substantially parallel to the axis 120 of the flashlight body 152 in the direction of the end that is configured to receive the lens assembly 156. The inner surface of the threaded section 174, which is adjacent the collar 164, includes a plurality of threads.

The collar 164, in this embodiment, includes two channels 180 that are configured to receive two tabs 182 which are preferably integrally formed on the inner surface of the lens assembly 156 substantially adjacent the opening 160. Hence, the lens assembly 156 is preferably positioned on the flashlight body 152 so that the two tabs 182 are inserted into the two channels 180 formed in the collar 164. In this embodiment, the flashlight body 152 and the opening 160 in the lens assembly 156 are preferably circular. Further, the tabs 182 are preferably positioned 180° apart. The threaded section 174 of the retaining ring 166 is preferably threadably engaged with the threads 162 formed at the end of the lens assembly 156 adjacent the opening 160. The flange 170 on the retaining ring 166 then engages with the collar 164 so that the lens assembly 156 is securely retained on the flashlight body 152.

It can be appreciated that, since the tabs 182 on the lens assembly 156 are engaged with the channels 180 in the collar 164, the tendency of the lens assembly 156 to rotate with respect to the flashlight body 152 is minimized. Hence, rotation of the lens assembly 156 relative the flashlight body 152 as a result of user manipulation of a fastener, such as a screw or bolt, using the flashlight tool 150 is also minimized.

The foregoing description of the preferred embodiments of the present invention illustrate that the flashlight tool of the present invention can be used to illuminate and manipulate fasteners. Specifically, the flashlight tool of the present invention provides a focused beam of light, that is largely unimpeded, which can be focused on the fastener to be manipulated. The structure of the flashlight tool of the present invention also allows for a plurality of different types of tool bits to be readily installed and used with the flashlight tool without resulting in a significant diminishing of the amount of light produced by the flashlight tool. Further, the flashlight tool of the present invention is designed so that rotation of an adjustable lens assembly, as a result of manipulation of a fastener by a user using the flashlight tool, is minimized.

Although the foregoing description of the preferred embodiment of the present invention has shown, described and pointed out the fundamental novel features of the invention, it will be understood that various omissions, substitutions, and changes in the form of the detail of the apparatus as illustrated, as well as the uses thereof, may be made by those skilled in the art, without departing from the spirit of the present invention. Consequently, the scope of the invention should not be limited to the foregoing discussion, but should be defined by the appended claims.

What is claimed is:

1. An apparatus for illuminating and manipulating fasteners, comprising:

a body containing a light source;

a lens assembly mounted on said body so that said lens assembly produces a beam of light which emanates from the light source so as to project in a first direction; and a tool mounting stud assembly, which includes a stud configured to receive one of a plurality of tools wherein said one of said plurality of tools has an opening which mates with said stud to retain said tool on said stud, said assembly also including a plurality of spokes extending outward from said stud which are connected to said lens assembly so that said stud is positioned within said beam of light that passes between the spokes of said stud assembly.

2. The apparatus of claim 1, wherein said body is generally tubular in shape and defines a space which is configured to receive one or more batteries which comprise a source of power for said light source.

3. The apparatus of claim 2, wherein said light source is comprised of a light bulb that is mounted at one end of said body.

4. The apparatus of claim 1, wherein said lens assembly includes a reflective shield configured to reflect light produced by said light source in said first direction.

5. The apparatus of claim 4, wherein said lens assembly includes a focusing lens mounted in an aperture in said lens assembly which is positioned in said first direction from said light source.

6. The apparatus of claim 5, wherein said focusing lens is recessed from an outer surface of said lens assembly so that a lip is formed about said aperture.

7. The apparatus of claim 6, wherein said spokes of said tool mounting stud assembly are attached to said lip of said lens assembly so as to be positioned in front of said focusing lens.

8. The apparatus of claim 7, wherein said focusing lens is substantially circular in shape and said spokes of said tool mounting stud assembly are connected to said lip so that said tool mounting stud is positioned at substantially the center of said focusing lens.

9. The apparatus of claim 8, wherein said tool mounting stud assembly includes a continuous ring which is connected to the outer ends of each of said spokes and wherein said continuous ring is connected to said lip along substantially the entire outer diameter of said continuous ring.

10. The apparatus of claim 1, wherein said lens assembly produces a focused beam of light and is adjustable so that the focal point of said focused beam of light can be adjusted.

11. The apparatus of claim 1, further comprising a securing mechanism which minimizes the tendency of said lens assembly to rotate relative said body when said apparatus is being used to manipulate a fastener.

12. The apparatus of claim 11, wherein said securing mechanism comprises at least one set screw which extends through an opening in said lens assembly and engages with said body to minimize the tendency of said lens assembly to rotate.

13. The apparatus of claim 11, wherein said body includes a collar, fixedly attached to an outer surface of said body at a position adjacent a first end of said body, which receives lens assembly, and a threaded retaining ring which is positioned about said body and retained thereon by said collar.

14. The apparatus of claim 13, wherein said lens assembly is configured to slide over said first end of said body and said surface of said lens assembly is threaded so that said retaining ring engages with said threads on said lens assembly to secure said lens assembly in a mounted configuration on said body.

15. The apparatus of claim 14, wherein said securing mechanism comprises at least one tab mounted on said lens assembly and at least one groove formed in said collar, wherein said tab is positioned in said groove when said lens assembly is mounted on said body to thereby minimize the tendency of said lens assembly to rotate relative said body in response to a user manipulating a fastener with said apparatus.

16. An apparatus for illuminating and manipulating fasteners comprising:

a body containing a light source;

a lens assembly mounted on said body so that said lens assembly, in conjunction with said light source, produces a beam of light;

a tool mounting stud configured to receive one of a plurality of tools connected to said lens assembly so that said tool mounting stud is positioned in said beam of light; and a tool, configured to manipulate a fastener, wherein said tool is mounted on said tool mounting stud and, when said tool is positioned adjacent a fastener to be manipulated, said tool and said fastener are illuminated by said beam of light.

17. The apparatus of claim 16, wherein said lens assembly includes a reflective shield configured to reflect light produced by said light source in a first direction.

18. The apparatus of claim 17, wherein said lens assembly includes a focusing lens mounted in an aperture in said lens assembly which is positioned in said first direction from said light source.

19. The apparatus of claim 18, wherein said focusing lens is recessed from said aperture in said lens assembly so that a lip is formed about said aperture.

20. The apparatus of claim 19, wherein said tool mounting stud is mounted in a first position relative said lens assembly so as to be substantially centered in said focusing lens and wherein said tool mounting stud is connected to said lip of said lens assembly by a plurality of spokes which extend from said tool mounting stud to said lip.

21. The apparatus of claim 16, further comprising a securing member which minimizes the tendency of said lens assembly to rotate relative said body when said apparatus is being used to manipulate a fastener.

22. The apparatus of claim 21, wherein said securing member comprises at least one set screw which extends through an opening in said lens assembly and engages with said body to minimize the tendency of said lens assembly to rotate.

23. The apparatus of claim 21, wherein said body includes a collar, fixedly attached to an outer surface of said body at a position adjacent a first end of said body, wherein said first end of said body receives said lens assembly, and said body further includes a retaining ring which is positioned about said body and retained thereon by said collar.

24. The apparatus of claim 23, wherein said lens assembly is configured to slide over said first end of said body and said retaining ring engages with said lens assembly to secure said lens assembly in a mounted configuration on said body.

25. The apparatus of claim 24, wherein said securing member comprises at least one tab mounted on said lens assembly and at least one groove formed in said collar, wherein said tab is positioned in said groove when said lens assembly is mounted on said body to thereby minimize the tendency of said lens assembly to rotate relative said body in response to a user manipulating a fastener with said apparatus.

26. The apparatus of claim 16, wherein said tool is configured to manipulate screws.

27. The apparatus of claim 16 wherein said tool is configured to manipulate nuts and bolts.

28. An apparatus for illuminating and manipulating fasteners comprising:

a body;

a light source mounted adjacent a first end of said body;

a lens assembly mounted on said first end of said body, said lens assembly including an aperture and a lens positioned in said aperture so as to be recessed therein, wherein said light source and said lens produces a light beam which projects in a first direction out of said aperture;

a tool mounting stud capable of receiving one of a plurality of tools which is positioned in a first location that is substantially adjacent the center of said lens and is in said first direction from said focusing lens;

a plurality of spokes that are connected to said tool mounting stud and connected to said lens assembly so as to retain said tool mounting stud in said first location; and a securing member which minimizes the tendency of said lens assembly to rotate relative said body when said apparatus is being used to manipulate a fastener.

29. The apparatus of claim 28, wherein a focusing lens is recessed from an outer surface of said lens assembly so that a lip is formed about said aperture and wherein said plurality of spokes are connected to said lip.

30. The apparatus of claim 29, wherein said plurality of spokes are interconnected by a continuous ring which is mounted on the ends of said spokes opposite said tool mounting stud and wherein said continuous ring is connected to said lip substantially along its entire outer surface.

31. The apparatus of claim 30, wherein said lens assembly produces a focused beam of light and is adjustable so that the focal point of said focused beam of light can be adjusted.

32. The apparatus of claim 28, wherein said securing member is comprised of a set screw which extends through an opening in said lens assembly and engages with said body to minimize the tendency of said lens assembly to rotate.

33. The apparatus of claim 28, wherein said securing member is comprised of a tab attached to said lens assembly and a channel formed in said body and wherein said tab engages with said channel to minimize the tendency of said lens assembly to rotate when said apparatus is used to manipulate a fastener.

34. An apparatus for illuminating and manipulating fasteners comprising:

a light source;

a reflector having an exterior surface that reflects light from said light source so that said light propagates in a first direction;

a transparent member positioned to receive and transmit said light propagated in said first direction;

a stud mounted to project forward of the transparent member in said first direction wherein said stud is capable of receiving one of a plurality of tools so as to retain said one of a plurality of tools in said light propagating in a first direction.

35. The apparatus of claim 34, wherein said transparent member comprises a focusing lens which produces a focused beam of light that propagates in said first direction and wherein said stud is mounted so as to be positioned in substantially the center of said focused beam of light.

36. The apparatus of claim 35, wherein said stud is a male stud which is configured to receive a tool that is configured to manipulate a fastener.

37. The apparatus of claim 34, wherein said focusing lens is recessed within an aperture so that a lip is formed about said focusing lens and said stud is positioned in front of said focusing lens by a plurality of spokes which are connected to said lip.

38. The apparatus of claim 37, wherein said focused beam of light passes between said plurality of spokes to illuminate a fastener to be manipulated by said apparatus.

* * * * *